US007380626B2

(12) United States Patent
Chikaishi et al.

(10) Patent No.: US 7,380,626 B2
(45) Date of Patent: Jun. 3, 2008

(54) SERVICE VEHICLE

(75) Inventors: Kouji Chikaishi, Kawasaki (JP); Akiko Konishi, Kawasaki (JP); Shotaro Ishii, Kawasaki (JP); Noboru Kanayama, Kawasaki (JP); Kazuhiro Yoshida, Kawasaki (JP)

(73) Assignee: Komatsu Ltd., Tokyo (JP)

( * ) Notice: Subject to any disclaimer, the term of this patent is extended or adjusted under 35 U.S.C. 154(b) by 220 days.

(21) Appl. No.: 11/219,102

(22) Filed: Sep. 1, 2005

(65) Prior Publication Data

US 2006/0000123 A1 Jan. 5, 2006

Related U.S. Application Data

(62) Division of application No. 10/613,556, filed on Jul. 2, 2003, now Pat. No. 7,168,191.

(30) Foreign Application Priority Data

Jul. 2, 2002 (JP) ..... 2002-193322

(51) Int. Cl.
*B62D 33/063* (2006.01)

(52) U.S. Cl. ..... 180/89.13; 137/571; 138/30; 220/562

(58) Field of Classification Search ..... 180/89.11, 180/89.1, 89.13, 327; 296/190.08; 220/562; 137/571, 575; 138/26, 30
See application file for complete search history.

(56) References Cited

U.S. PATENT DOCUMENTS 2,316,729 A 4/1943 Tryon
2,418,231 A 4/1947 Kimm et al.
3,217,469 A 11/1965 Eckert
3,397,512 A 8/1968 Webb
3,452,518 A 7/1969 Skaug et al.
3,844,743 A 10/1974 Jones
4,039,305 A 8/1977 Livesay
4,541,850 A 9/1985 Oda et al.
4,617,031 A 10/1986 Suh et al.
4,664,134 A * 5/1987 Pera ..... 137/14
4,771,855 A 9/1988 Takashima et al.

(Continued)

FOREIGN PATENT DOCUMENTS

JP 54-079016 U 11/1952

(Continued)

*Primary Examiner*—Paul N. Dickson
*Assistant Examiner*—Drew J. Brown
(74) *Attorney, Agent, or Firm*—Frishauf, Holtz, Goodman & Chick, P.C.

(57) ABSTRACT

A hydraulic excavator is equipped with one or more downsizing scheme including at least one of: (i) a bubble removing device for removing bubbles in hydraulic fluid, (ii) a hydraulic tank including a main tank and a variable capacity tank arranged separately from each other, and (iii) a variable capacity tank or hydraulic tank which is fitted to the rear surface of the upper cover of the seat-side block. Thus, the lateral section of the seat can be ultimately downsized to provide a large space around the seat. Then, unlike the prior art, a canopy or a cab of a larger hydraulic excavator can be securely arranged on the upper swing body of a small hydraulic excavator. Since such large parts can be commonly used with large hydraulic excavators, it is possible to significantly reduce the cost of the hydraulic excavator.

15 Claims, 14 Drawing Sheets

U.S. PATENT DOCUMENTS

| | | | | |
|---|---|---|---|---|
| 4,865,632 | A | 9/1989 | Yano et al. | |
| 4,878,924 | A | 11/1989 | Yano et al. | |
| 4,890,764 | A * | 1/1990 | Rossini | 220/560.02 |
| 5,018,551 | A * | 5/1991 | Pelissier | 137/571 |
| 5,202,026 | A | 4/1993 | Lema | |
| 5,755,965 | A | 5/1998 | Reiber | |
| 5,975,833 | A | 11/1999 | Yamada et al. | |
| 6,134,816 | A | 10/2000 | Murakami et al. | |
| 2002/0007736 | A1 | 1/2002 | Hearn et al. | |
| 2002/0056675 | A1 | 5/2002 | Hegde | |
| 2002/0059959 | A1* | 5/2002 | Qatu et al. | 138/30 |
| 2002/0108486 | A1 | 8/2002 | Sannomiya et al. | |
| 2003/0233942 | A1 | 12/2003 | Konishi et al. | |
| 2004/0163865 | A1 | 8/2004 | Shimokakiuchi et al. | |

FOREIGN PATENT DOCUMENTS

| | | | |
|---|---|---|---|
| JP | 50-118961 | A | 9/1975 |
| JP | 56-083602 | A | 7/1981 |
| JP | 61-124701 | | 6/1986 |
| JP | 61-124701 | | 8/1986 |
| JP | 62-066001 | U | 4/1987 |
| JP | 02-052013 | | 2/1990 |
| JP | 04-105604 | U | 9/1992 |
| JP | 06-028303 | U | 4/1994 |
| JP | 07-144544 | A | 6/1995 |
| JP | 08-013543 | A | 1/1996 |
| JP | 11-081380 | A | 3/1999 |
| JP | 11-269927 | A | 10/1999 |
| JP | 11-303819 | A | 11/1999 |
| JP | 2000-291069 | A | 10/2000 |
| JP | 2001-027204 | A | 1/2001 |
| JP | 2002-129595 | A | 5/2002 |

* cited by examiner

SERVICE VEHICLE

CROSS-REFERENCE TO RELATED APPLICATION

This application is a Divisional application of U.S. application Ser. No. 10/613,556, filed on Jul. 2, 2003 now U.S. Pat. No. 7,168,191.

BACKGROUND OF THE INVENTION

1. Field of the Invention

This invention relates to a service vehicle typically equipped with a hydraulically driven work implement such as a hydraulic excavator or another construction machine.

2. Description of the Related Art

Relatively small hydraulic excavators having a turning diameter smaller than the width of the vehicle main body are known. In the case of hydraulic excavators, the upper swing body is mounted on the vehicle main body, which has a pair of lower running bodies (generally crawlers). In the case of such a small hydraulic excavator, the upper swing body turns within the width of the vehicle main body, including the width of the paired lower running bodies, so that it does not move out of the width of the vehicle. Therefore, such a hydraulic excavator is advantageously used in city centers, residential areas and other areas where the lot is normally small, because it can make a small turn.

Canopy type models and cab type models of hydraulic excavators are available so that either model can be selected at the time of purchase. The canopy type model is equipped only with a canopy arranged above the operator seat so that it is less costly and the operator can get onto and away from the seat without difficulty. On the other hand, the operator seat of the cab type model is enclosed by a box-like cab so that the operator is reliably protected against rainfall and wind and therefore can comfortably work in the cab.

Meanwhile, dedicated parts are developed and prepared conventionally for small and large hydraulic excavators based on the size of the vehicle. Such a process of developing parts is rather costly. In view of the current circumstances where cost reduction is an imposing requirement to be met regardless of the size of the machines, efforts are being made to develop parts that can be commonly used for machines of any size for the purpose of cost reduction.

Additionally, to enable the hydraulic excavator to be operated comfortably, it is necessary that sufficient space be provided around the operator seat. Therefore, there is a practice of mounting a cab developed for a large hydraulic excavator on a small one in an effort to provide parts that are commonly used for all the types. However, when a cab developed for a large hydraulic excavator is mounted on the upper swing body of a small hydraulic excavator, the cab disadvantageously extends past the upper swing body to a large extent.

SUMMARY OF THE INVENTION

A principal object of the present invention is to provide a service vehicle of the type in which the upper swing body can turn within the width of the vehicle (to be referred to as intra-width turning type hereafter) and for which large parts including a canopy or a cab can be commonly used with larger service vehicles so as to significantly reduce the cost.

A service vehicle according to the present invention comprises an upper swing body mounted on the vehicle main body and adapted to turn within the width of the vehicle main body, and a downsizing scheme for downsizing a side block of the seat (to be referred to as a seat-side block hereafter) on the upper swing body.

Any appropriate downsizing scheme may be used for the purpose of the present invention. For example, it may be realized by using a flexible air chamber that is separated from a main tank of the hydraulic tank in order to reduce the overall dimensions of the hydraulic tank and hence those of the seat-side block. Alternatively, it may be realized by using a bubble removing device for removing bubbles from hydraulic fluid in order to reduce the overall dimensions of the hydraulic tank and hence those of the seat-side block. Alternatively, it may be realized by any arrangement of part or all of the hydraulic tank in a seat-side block so as to improve the efficiency of arrangement in the seat-side block so as to downsize the seat lateral section.

Thus, when a service vehicle of the intra-width turning type is provided with such a downsizing scheme, the seat-side block is ultimately downsized so that space is generously provided around the seat. Therefore, unlike previous service vehicles, a canopy or a cab adapted to a large service vehicle can be reliably and securely arranged on the upper swing body of a small service vehicle. Then, such a large part can be commonly used for both large and small service vehicles to consequently reduce the cost of manufacturing a service vehicle.

Preferably, in a service vehicle according to the present invention, a step section is provided in front of the seat-side block on the upper swing body so as to allow the operator to move from the seat to the outside of the vehicle and vice versa.

In the case of a hydraulic excavator not provided with a cab (e.g., of the canopy model), the seat is open to the outside at every side thereof, unlike the cab model, so that the operator can easily get onto and away from the seat. However, a large lateral section is arranged at a side (normally the right side) of the seat on the upper swing body of the conventional canopy model to contain a hydraulic tank, a control valve or the like. Therefore, the operator is forced to get onto and away from the seat from the side opposite to the lateral section as in the case of the cab model. Additionally, since the seat is open at the front side thereof, the operator may get onto and away from the seat through the front side. However, in practice it is not easy for the operator to do so because the lateral section provides a considerable obstacle to movement by the operator. In short it is difficult to satisfactorily exploit the advantages of conventional service vehicles of the canopy model and there is a demand for improved service vehicles that allow the operator to easily get onto and away from the seat of the vehicle.

According to the present invention, a downsizing scheme is provided to downsize the seat-side block and create a space to allow a step section to be provided at the front side of the seat-side block to utilize the space produced by the downsizing scheme. Thus, the operator can get onto the seat from the outside by way of the seat-side block, using the step section. The operator can also get away from the seat to the outside in a similar manner to fully exploit the advantages of the canopy model.

Preferably, a service vehicle comprising an upper swing body mounted on the vehicle main body and adapted to turn within the width of the vehicle according to the present invention is provided with a hydraulically driven work implement arranged substantially at the center of the upper swing body, a cab for covering the seat mounted on the upper swing body and a downsizing scheme (such as a bubble removing device, a separable hydraulic tank or a variable capacity tank fitted to an upper cover of the seat-side block) for downsizing the seat-side block on the upper swing body, the work implement being apt to tilt toward the seat side across a fitting section of the upper swing body.

Since the cab of a hydraulic excavator is normally box-shaped and larger than a canopy, the front side of the cab is located forward on the vehicle main body relative to the front side of the canopy of a similar hydraulic excavator. In other words, the cab is located close to the work implement. Therefore, in a conventional hydraulic excavator of the cab model, the boom of the work implement cannot tilt toward the seat side across the fitting section thereof. Thus, it is not possible for a hydraulic excavator of the cab model to have a maximum dumping height and a maximum digging height that are as high as those of a hydraulic excavator of the canopy model.

To the contrary, in a hydraulic excavator of the cab model according to the present invention, the cab can be arranged at a position placed rearward compared with the position of the cab of a conventional hydraulic excavator because the seat-side block is downsized by the downsizing scheme so that the work implement can be tilted toward the seat side across the fitting section thereof to a large extent. Thus, the operating range of the work implement of a hydraulic excavator of the cab model is made as large as that of the work implement of a comparable hydraulic excavator of the canopy model. Obviously, such a hydraulic excavator of the cab model can be handled easily.

Preferably, a service vehicle comprising an upper swing body mounted on the vehicle main body and adapted to turn within the width of the vehicle according to the present invention is provided with a hydraulically driven work implement and a downsizing scheme (such as a bubble removing device, a separable hydraulic tank or a variable capacity tank fitted to an upper cover of the seat-side block) for downsizing the seat-side block on the upper swing body, the service vehicle being either of the model having a cab covering the seat arranged on the upper swing body or of the model not having a cab, and the work implement being common to the two models.

As described above with regard to a service vehicle according to the present invention, the operating range of the work implement of a conventional service vehicle of the cab model and that of the work implement of a conventional service vehicle of the canopy model differ from each other. In other words, the manufacturing specifications of the former work implement differ from those of the latter work implement. More specifically, a special mechanism for limiting the movement of the boom may be provided in a hydraulic excavator of the cab model having a small operating range, which increases the number of components. Then, servicing work implements that are manufactured according to different manufacturing specifications is cumbersome.

To the contrary, according to the present invention, the position of the cab of a cab model service vehicle can be displaced to allow the use of a work implement having an operating range as large as that of the work implement of a canopy model service vehicle so that work implements can be commonly used for service vehicles regardless of the model of the vehicle. In other words, no specially designed mechanism for limiting the movement of the boom is needed for service vehicles of the cab model and work implements can be controlled easily during manufacturing before they are mounted on service vehicles. Cost reduction will thereby be promoted for such service vehicles.

DETAILED DESCRIPTION OF THE PREFERRED EMBODIMENTS

Now, the present invention will be described by referring to the accompanying drawings that illustrate preferred embodiments of the present invention.

Of the embodiments that will be described hereafter, the first one is a hydraulic excavator (service vehicle) 1 without a cab and the second one is a hydraulic excavator (service vehicle) 2 with a cab.

The hydraulic excavator 1 without a cab may be a hydraulic excavator of the canopy model or a hydraulic excavator of a model that does not even have a canopy. In short, it is a hydraulic excavator of any model that does not have a cab. The components that are common to both the hydraulic excavator 1 of the first embodiment and the hydraulic excavator 2 of the second embodiment will be described only by referring to the hydraulic excavator 1 of the canopy model of the first embodiment and, unless necessary, will not be described any further in terms of the hydraulic excavator 2 of the cab model of the second embodiment.

1st Embodiment/Canopy Model

Figure 1:
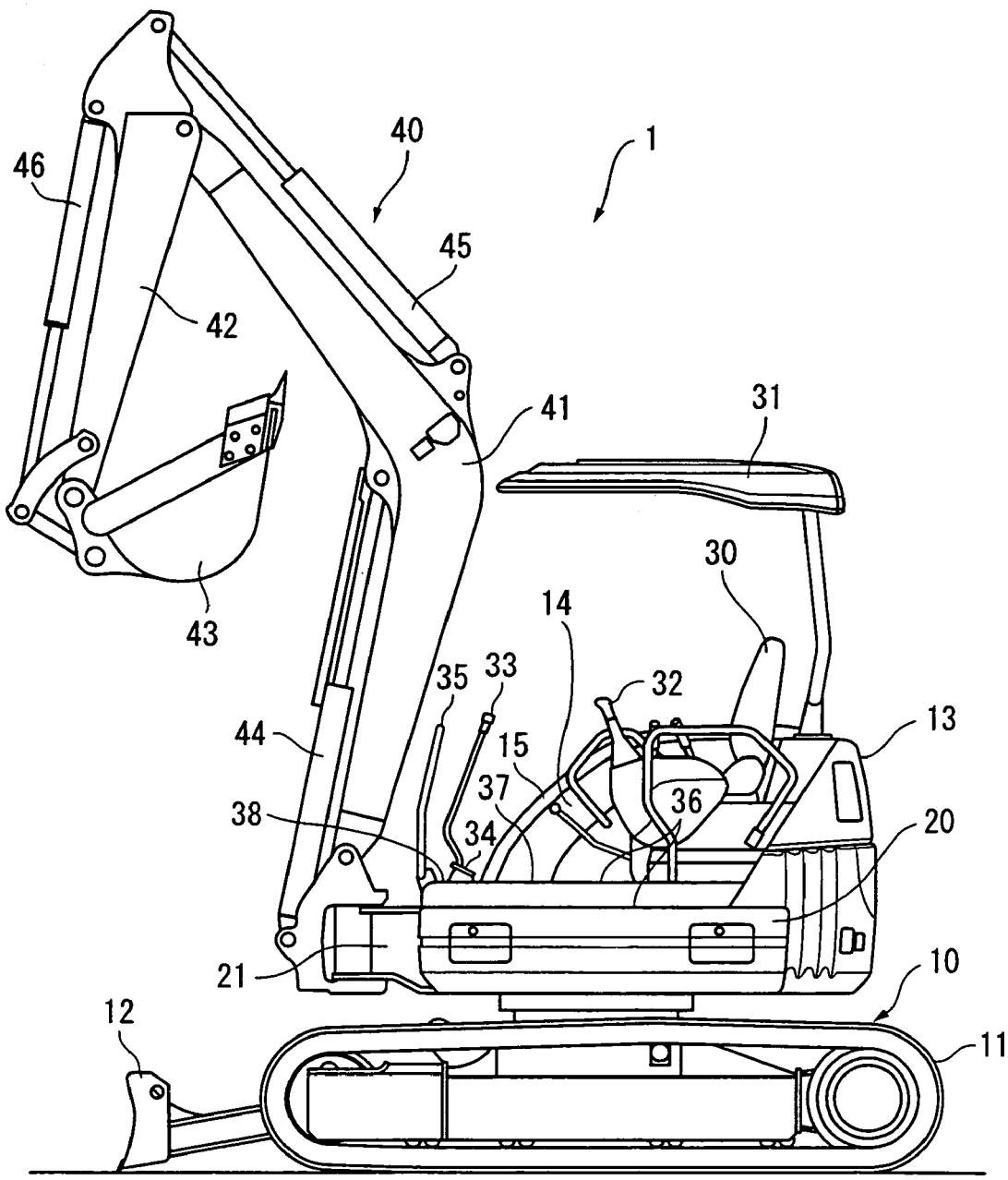
FIG. 1 is a schematic lateral view of the first embodiment of a service vehicle according to the present invention, showing the entire profile of the canopy model.
Figure 2:
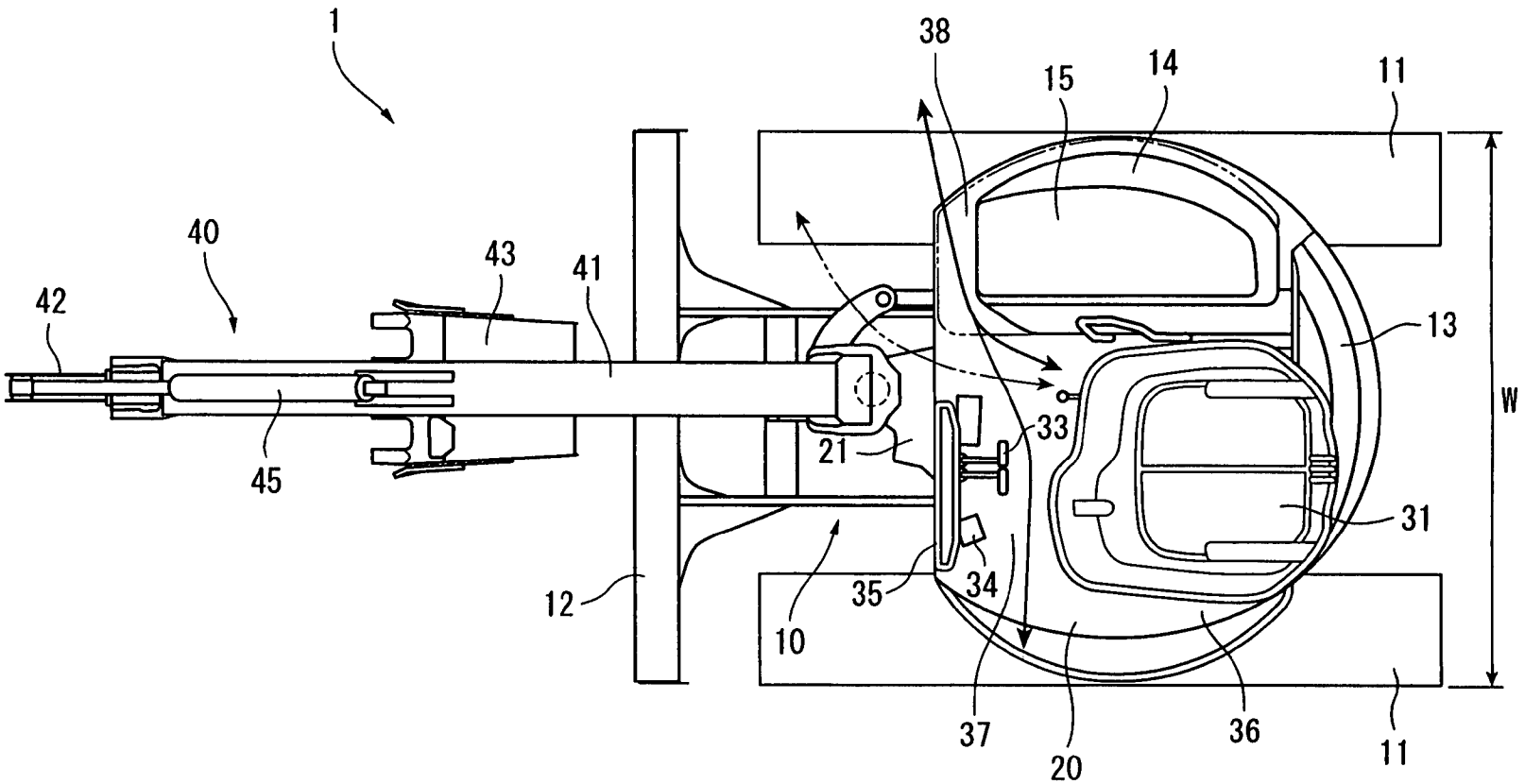
FIG. 2 is a schematic plan view of the first embodiment, showing the entire overhead view thereof.

FIG. 1 is a schematic lateral view showing the entire profile of the hydraulic excavator 1 of the canopy model and FIG. 2 is a schematic plan view showing the entire overhead view thereof. Note that a work implement 40, which will be described hereafter, is tilted differently in FIGS. 1 and 2.

The hydraulic excavator 1 comprises a vehicle main body 10 including a pair of lower running bodies 11 of the crawler type, an upper swing body 20 arranged on the vehicle main body 10 so as to be able to swing, a seat 30 arranged at an upper area of the upper swing body 20 and a work implement 40 arranged at the front side (in a state in which the operator is properly sitting on the seat 30 and at the left side in FIG. 1) of the upper swing body 20. A canopy 31 is arranged above the seat 30.

As shown in FIG. 2, the hydraulic excavator 1 is of the intra-width turning type. In other words, the upper swing body 20 can swing within the width W of the vehicle main body 10. A fitting section 21 that projects forward is arranged at the front side of the upper swing body 20 at a position substantially at the middle in the lateral direction of the vehicle main body 10. The work implement 40 is secured to the fitting section 21.

In the hydraulic excavator 1, the lower running bodies 11 and the blade 12 that are arranged at the vehicle main body 10 and the work implement 40 are hydraulically driven in a conventional manner. A hydraulic pump (not shown) for generating hydraulic pressure, an engine and other components (not shown) for driving the hydraulic pump are mounted in an engine room 13 that is arranged at the rear side of the vehicle main body 10.

A seat-side block 14 that stands substantially as high as the engine room 13 is arranged on the right side of the seat 30 on the vehicle main body 10. The seat-side block 14 contains therein a control valve (not shown) for controlling the hydraulic pressure from the hydraulic pump, a fuel tank (not shown) and a hydraulic tank 50 shown in FIGS. 3 through 5.

The work implement 40 that is driven by the hydraulic pressure applied from the hydraulic pump is structurally a conventional one. More specifically, it has a boom 41 which pivots at the fitting section 21 of the upper swing body 20, an arm 42 which pivots at the front end of the boom 41 and a bucket 43 which pivots at the front end of the arm 42, which are adapted to be driven to move respectively by means of a boom cylinder 44, an arm cylinder 45 and a bucket cylinder 46. The boom 41 can be tilted toward the seat 30 across the fitting section 21 (FIG. 1).

The work implement 40 is operated by means of work implement levers 32 arranged at the right and left sides of the seat 30, while the lower running bodies 11 are operated by means of running levers 33 and running pedals 34 arranged in front of the seat 30. The seat 30 on which the operator sits is placed rearward at a position close to the center on the upper swing body 20 compared with the position of the seat of a comparable conventional service vehicle. Therefore, a through area 37 is provided on and above a floor 36 behind a handrail 35.

The seat-side block 14 located adjacent to the seat 30 is downsized compared with the seat-side block of a comparable conventional service vehicle as indicated by a dotted broken line in FIG. 2 to provide space for arranging a step section 38 that communicates with the through area 37 and that is located in front of the seat-side block 14. While the operator is forced to move through a narrow gap between the fitting section 21 and the seat-side block 14 (along the dotted broken lines with arrows) on a comparable conventional service vehicle, space is generously provided in front of the seat-side block 14 due to the provision of the step section 38 so that the operator can move freely from the seat 30 to the outside and also the other way (along the solid lines with arrows).

Now, the hydraulic tank 50 will be described by referring to FIGS. 3 through 5.

Figure 3:
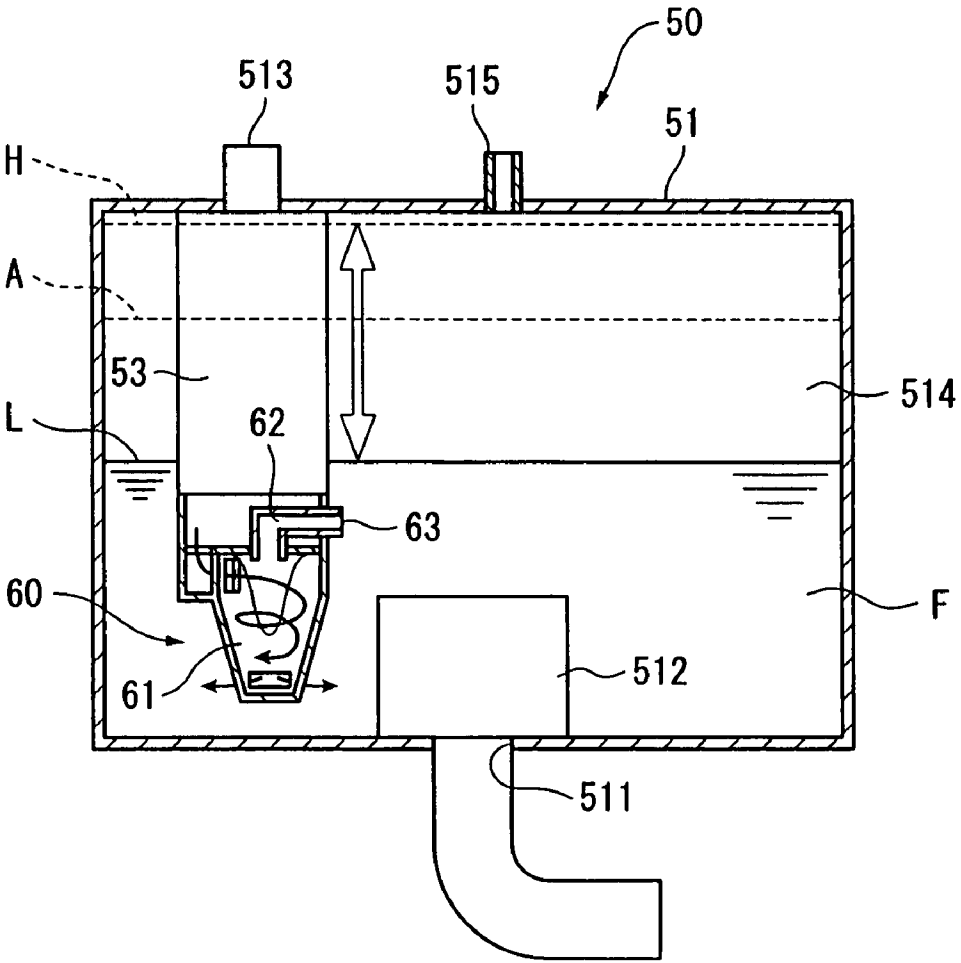
FIG. 3 is a schematic cross sectional view of the main tank of the hydraulic tank of the first embodiment.
Figure 4:
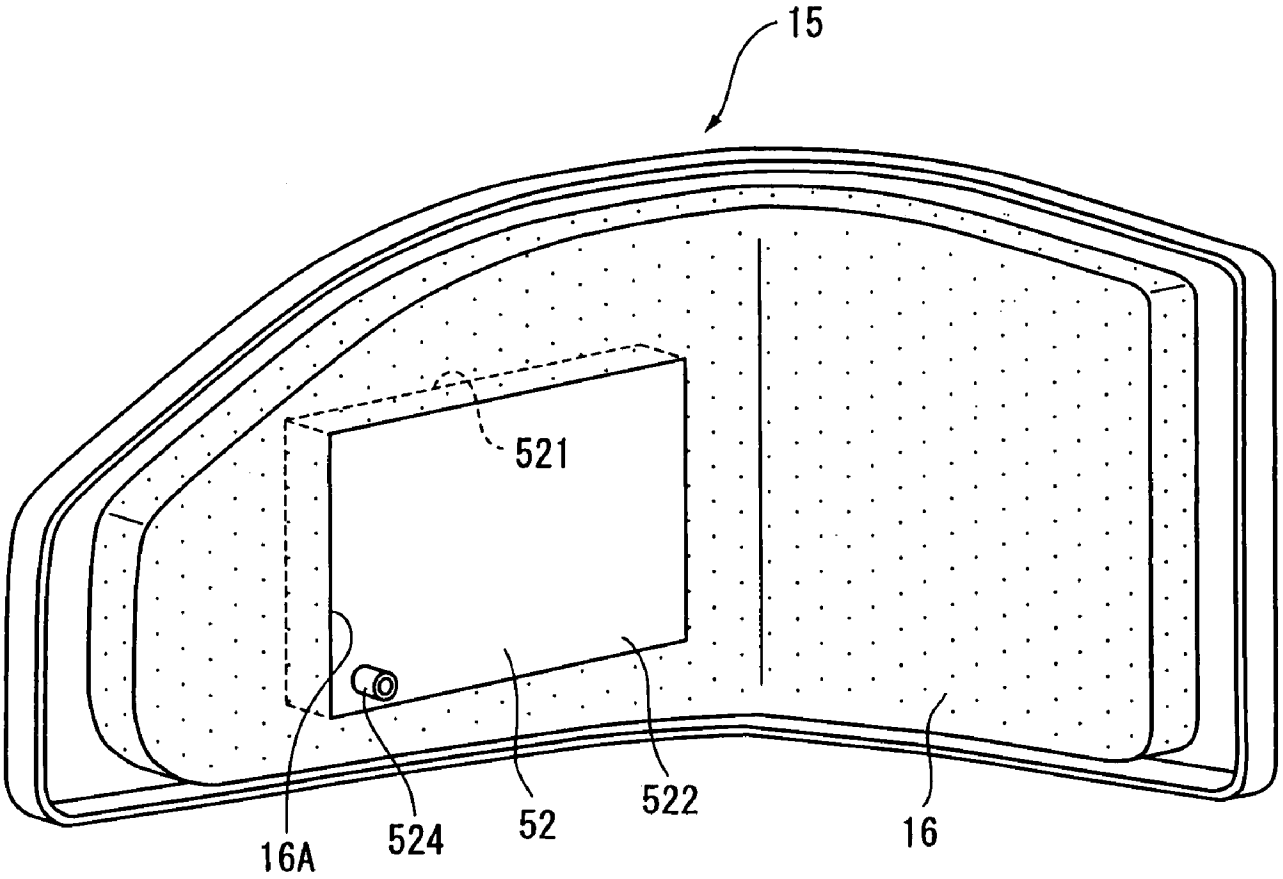
FIG. 4 is a schematic perspective view of the variable capacity tank of the hydraulic tank of the first embodiment, illustrating how it is fitted in position.
Figure 5:
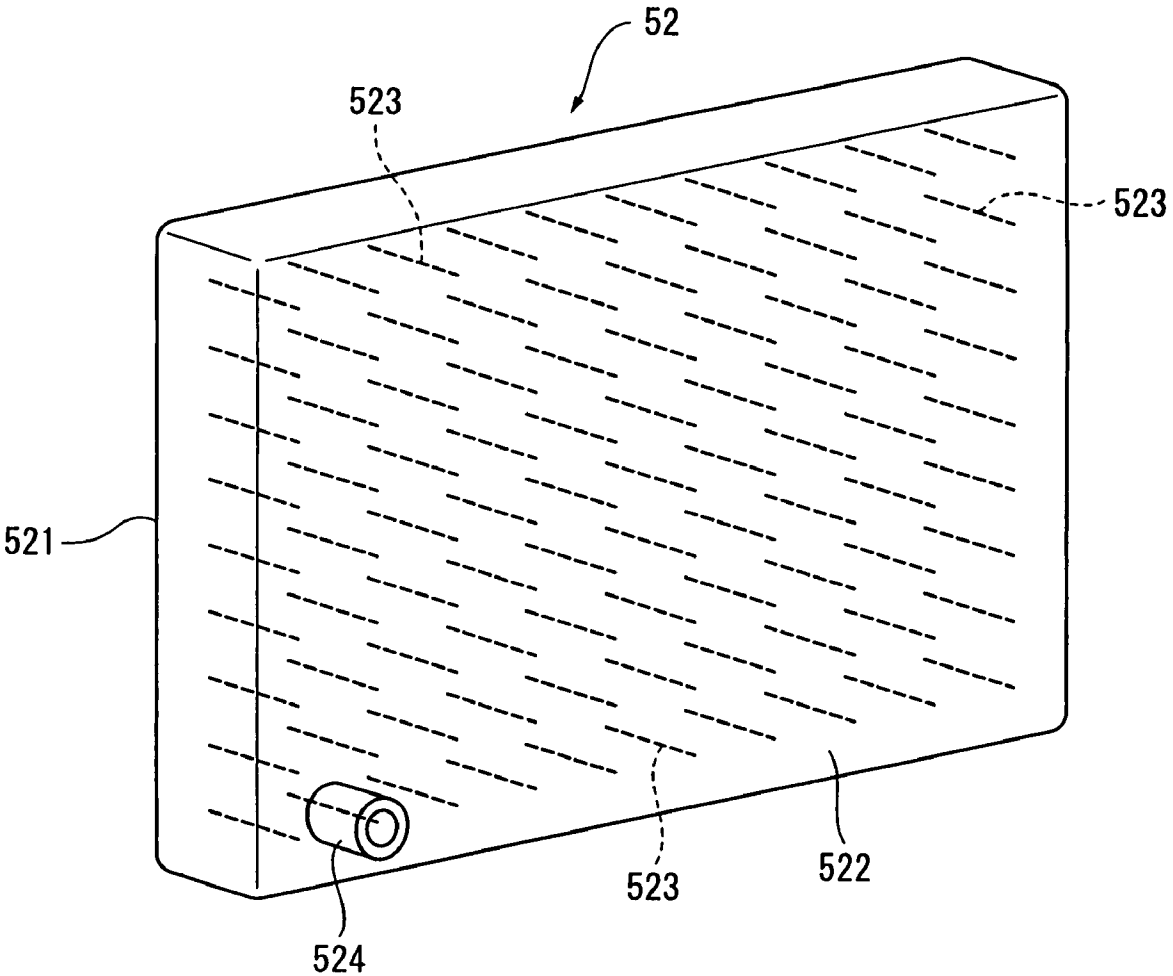
FIG. 5 is a schematic perspective view of the variable capacity tank of the first embodiment, illustrating the entire profile thereof.
Figure 6:
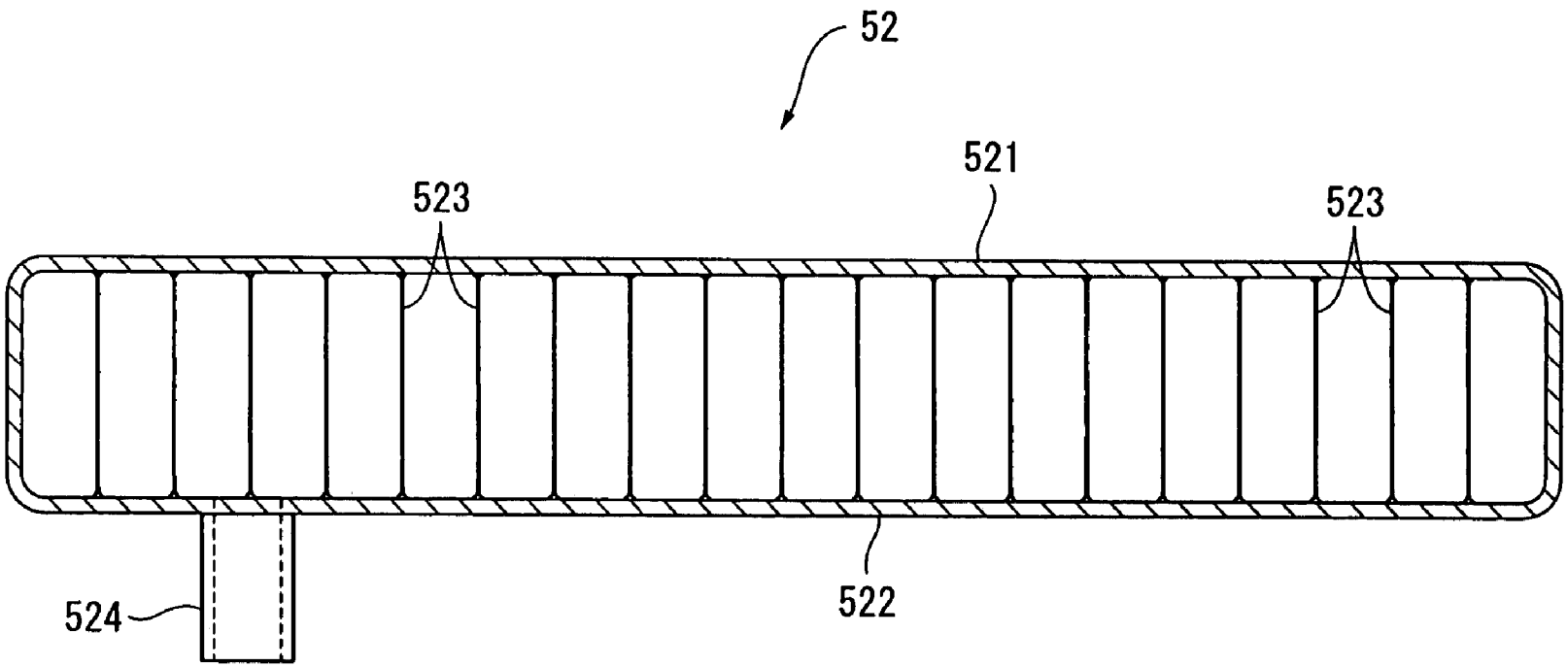
FIG. 6 is a schematic cross sectional view of the variable capacity tank of the first embodiment.

The hydraulic tank 50 is of the separable type that includes a main tank 51 as shown in FIG. 3 and a variable capacity tank 52 as shown in FIGS. 4 and 5. The main tank 51 mainly contains hydraulic fluid F therein, whereas air flows into and out of the variable capacity tank 52.

The main tank 51 is a rigid tank typically made of metal and provided at the bottom thereof with an oil outlet port 511 through which hydraulic fluid is driven out toward the cylinders 44 through 46 by means of a hydraulic pump (not shown). A suction strainer 512 is arranged so as to cover the oil outlet port 511. An oil return port 513 is arranged at the top of the main tank 51 so that hydraulic fluid is brought back to the main tank 51 from the cylinders 44 through 46 by way of the oil return port 513. The hydraulic fluid that is returned by way of the oil return port 513 is received in the main tank 51 by way of a filter 53 and a bubble removing device 60.

The bubble removing device 60 is of a cyclone type. As hydraulic fluid containing bubbles and coming from the filter 53 is made to flow into a cyclone chamber 61 along a tangential direction, a swirling flow of hydraulic fluid is generated in the cyclone chamber 61. As a swirling flow arises, bubbles having a low specific gravity are forced to concentrate at the center. Concentrated bubbles are then forced to move through the flow path 62 for delivering bubbles and driven into the hydraulic fluid contained in the main tank 51 through a delivery port 63. Then the bubbles move upward and become discharged into the air. The hydraulic fluid from which bubbles are removed is then made to flow into the hydraulic fluid already found in the main tank 51 through a lower part of the cyclone chamber 61.

Conventional hydraulic tanks are not provided with such a bubble removing device 60 and therefore the hydraulic fluid returning to the hydraulic tank contains a large amount of bubbles. Conventional hydraulic tanks are designed to contain a large volume of hydraulic fluid, and the hydraulic fluid that is returned to the tank is prevented from being driven out immediately, for the purpose of removing bubbles. In other words, time is given to the hydraulic fluid that is returned to the tank so that bubbles may move up and become discharged into the air contained in the air chamber 514. Such a conventional hydraulic tank is therefore by far larger than the hydraulic tank 50 of this embodiment.

Differently stated, the volume of hydraulic fluid in the hydraulic tank 50 (particularly in the main tank 51) can be reduced to thereby reduce the capacity of the hydraulic tank 50 by providing a bubble removing device 60 so that the hydraulic tank 50, and hence the seat-side block 14 where the hydraulic tank 50 is arranged, can be downsized. Thus, the bubble removing device 60 of this embodiment operates as the downsizing scheme for the purpose of the present invention. The bubble removing device 60 is not limited to the cyclone type and may alternatively be of any other type. Additionally, it may be arranged outside the main tank 51.

Meanwhile, referring to FIG. 3, the level A of the surface of hydraulic fluid in the main tank 51 corresponds to certain intermediate positions of the cylinders 44 through 46. The level L of the surface of hydraulic fluid is the minimum (lowest) level of hydraulic fluid and corresponds to the head side positions of the pistons of the cylinders 44 through 46, where a large volume of hydraulic fluid is sent to the bottom sides of the cylinders from the main tank 51. Finally, the level H of the surface of hydraulic fluid is the maximum (highest) level of hydraulic fluid and corresponds to the bottom side positions of the pistons of the cylinders, where a large volume of hydraulic fluid is returned from the bottom sides of the cylinders to the main tank 51.

The capacity of the main tank 51 is substantially equal to the maximum volume of hydraulic fluid in the hydraulic tank 50, corresponding to when the surface of hydraulic fluid is at level H. When the surface of hydraulic fluid is at level H, the air chamber 514 does not practically exist at all in the main tank 51. This is because, as the surface of hydraulic fluid in the main tank 51 rises from level L or level A to level H, the air contained in the air chamber 514 is forced to move into the variable capacity tank 52 through a communicating section 515.

The variable capacity tank 52 is formed to have a flexible, hollow and highly airtight mattress-shape typically by using a multilayer sheet of synthetic resin such as polychloroprene or polyamide. In this embodiment, it is arranged at the rear surface side of the upper cover 15 of the seat-side block 14. Thus, one of the surfaces of the variable capacity tank 52 is designed to operate as fitting surface section 521 to be fitted to the upper cover 15 by an appropriate fitting unit and the opposite surface is designed to operate as movable surface section 522. The surface sections 521, 522 are linked together by means of a large number of fiber-like confining members 523 that are typically made of polyester. A communicating section 524 is arranged at a part of the movable surface section 522.

The communicating section 524 is held in communication with the communicating section 515 of the main tank 51 by way of a tube (see FIG. 7) or the like so that air may flow into and out of the air chamber 514 of the main tank 51 by way of the communicating section 524. As air moves from the air chamber 514 into the variable capacity tank 52, the tank 52 inflates. Since the movable surface section 522 is restricted in the extent of its movement and hence in the extent of inflation of the variable capacity tank 52 by the confining members 523, the mattress-shape of the variable capacity tank 52 is maintained if the tank 52 is inflated. In other words, any central part of the variable capacity tank 52 does not project disproportionately and the entire variable capacity tank 52 maintains a uniform thickness. Furthermore, the variable capacity tank 52 is fitted in the opening section 16A of the sound absorbing member 16 bonded to the upper cover 15 so as to be buried there and hence, when it is inflated maximally (as the surface of hydraulic fluid in the main tank 51 is at level H), the movable surface section 522 is substantially flush with the surface of the sound absorbing member 16.

The maximum capacity of the variable capacity tank 52 is smaller than the capacity of the air chamber 514 defined by the minimum level L of the surface of hydraulic fluid in the main tank 51. As a matter of fact, it is about a half of the capacity of the air chamber 514 in this embodiment. In other words, as the surface of hydraulic fluid in the main tank 51 rises from level L to level H, the capacity of the air chamber 514 falls from the largest to nil to maximize the volume of air that is forced to move from the main tank 51 into the variable capacity tank 52. The air that is forced to move into the variable capacity tank 52 is compressed and stored in the variable capacity tank 52. Thus, the air pressure in the variable capacity tank 52 is nearly doubled from the air pressure in the air chamber 514 and the variable capacity tank 52 is formed to bear this pressure. Therefore, the hydraulic tank 50 as a whole can be downsized if compared with the metal-made hydraulic tank of a conventional service vehicle. This will be discussed below in greater detail by referring to FIG. 7.

Figure 7:
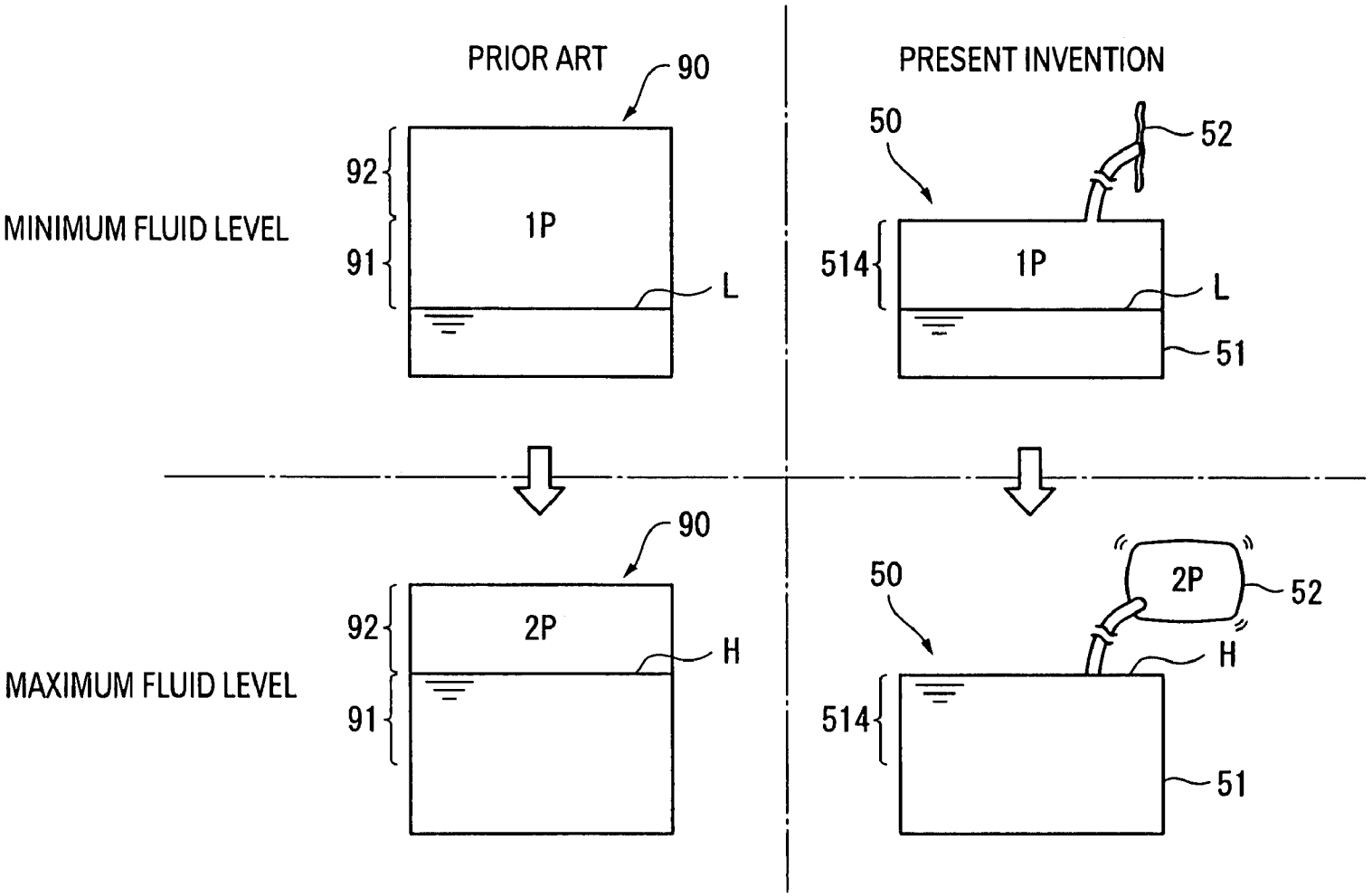
FIG. 7 is a schematic illustration of the difference between the hydraulic tank of the first embodiment and that of a conventional service vehicle.

The metal-made hydraulic tank 90 of the prior art illustrated in FIG. 7 is provided with an air chamber 91 that corresponds to the air chamber 514 of this embodiment in order to accommodate changes in the volume of hydraulic fluid stored in the tank 90. The hydraulic tank 90 is additionally provided with another air chamber 92 having a capacity substantially equal to that of the air chamber 91, which makes the entire hydraulic tank 90 very large. Such a large tank 90 is needed in order to suppress the air pressure exerted on the surface of hydraulic fluid at the maximum level H to about twice (2P) of the air pressure (1P) exerted on the surface of hydraulic fluid at the minimum level L.

To the contrary, the space that corresponds to the air chamber 92 of the prior art is eliminated from the main tank 51 of this embodiment. In other words, the main tank 51 is provided only with an air chamber 514 that corresponds to the air chamber 91 of the prior art. Additionally, the variable capacity tank 52 is arranged separately from the main tank 51 so that air can be moved away from the air chamber 514 (that corresponds to the air chamber 91 of the prior art). The maximum capacity of the variable capacity tank 52 is made to be equal to half of the capacity of the air chamber 514 such that the air pressure exerted on the surface of hydraulic fluid to be equal to 2P, as is the case of the prior art when the hydraulic fluid is at level H, when the air in the air chamber 514 is forced out.

Thus, the hydraulic tank 50 of this embodiment includes only the main tank 51 that can contain hydraulic fluid up to level H and the variable capacity tank 52 having a capacity that is equal to the capacity of the air chamber 91 (which is equal to the capacity of the air chamber 92) of the prior art. Therefore, the hydraulic tank 50 of this embodiment is downsized if compared with the hydraulic tank 90 of the prior art due to the arrangement of separating the main tank 51 and the variable capacity tank 52 of the hydraulic tank 50. As a result, the seat-side block 14 for containing the hydraulic tank 50 of this embodiment is downsized. Thus, the arrangement of separating the main tank 51 and the variable capacity tank 52 of the hydraulic tank 50 also operates as the downsizing scheme for the purpose of the present invention. Further, in this embodiment, as described before, bubble removing device 60 in the main tank 51 of the hydraulic tank 50 also operates as the downsizing scheme. Note that the bubble removing device 60 in the main tank 51 is not shown in FIG. 7.

Furthermore, in this embodiment, the variable capacity tank 52 is fitted to the part of the rear surface of the upper cover 15 where the sound absorbing member 16 may need to be bonded in a comparable conventional hydraulic excavator. In other words, the variable capacity tank 52 does not require space dedicated to it. Thus, the arrangement of fitting the variable capacity tank 52 to the rear surface of the upper cover 15 also operates as the downsizing scheme for the purpose of the present invention because it reduces the necessary internal space of the seat-side block 14 and hence downsizes the seat-side block 14.

Because of the above described downsizing scheme, the seat-side block 14 is downsized to provide space on the upper swing body 20 so that the position of the seat 30 is placed rearward at a position close to the center on the upper swing body 20 compared with the position of the seat of a comparable conventional service vehicle. Therefore, a through area 37 and a step section 38 can be provided on and above the floor 36. Additionally, a canopy 31 that is larger than its counterpart of the prior art can be arranged to cover the seat 30 due to the newly provided space. In other words, a canopy 31 that is used in a larger canopy model hydraulic excavator can be applied to this embodiment of the present invention.

2nd Embodiment/Cab Model

The hydraulic excavator 2 of the cab model will be described by referring to FIGS. 8 and 9.

Figure 8:
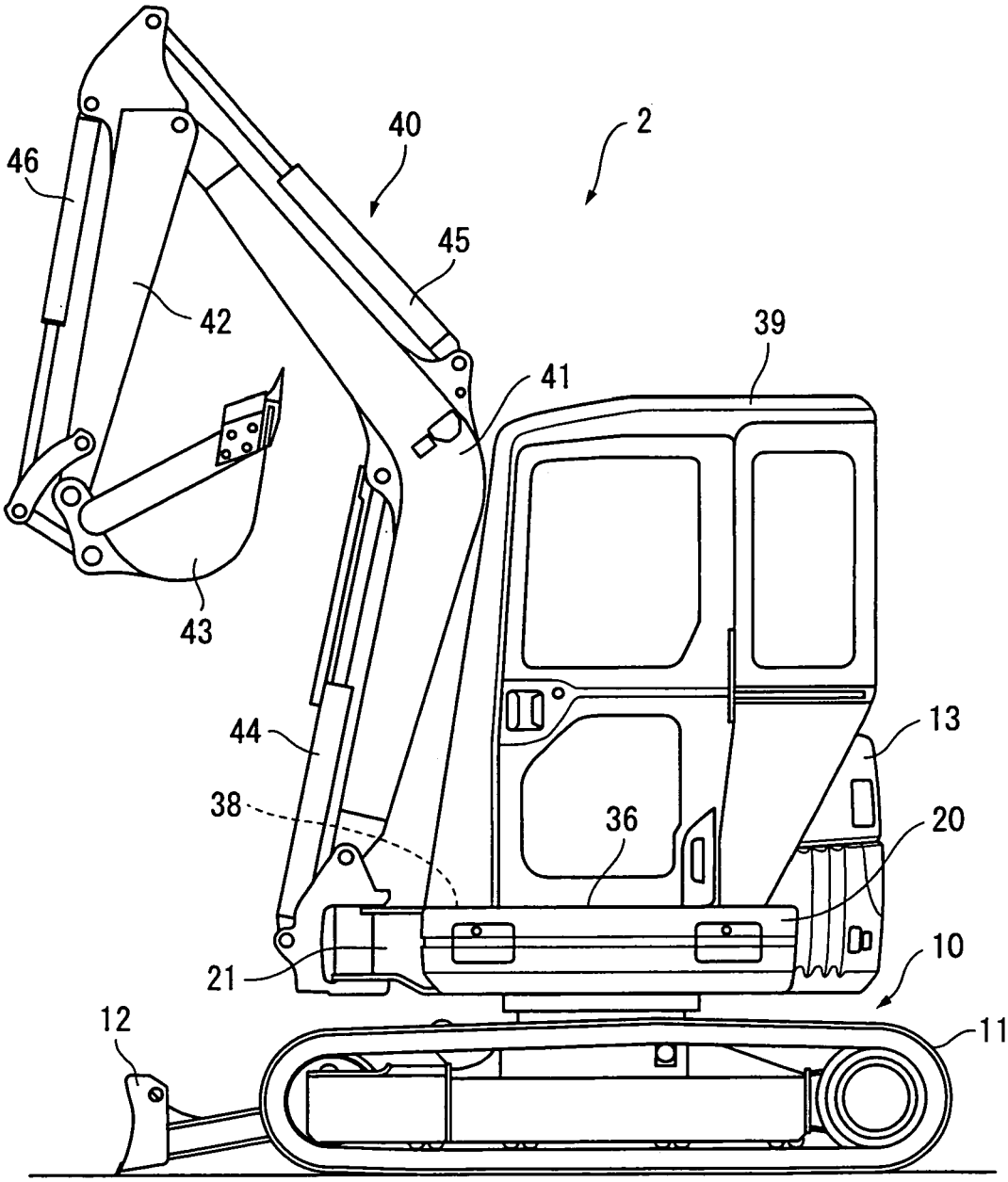
FIG. 8 is a schematic lateral view of the second embodiment of service vehicle, showing the entire profile of the cab model.
Figure 9:
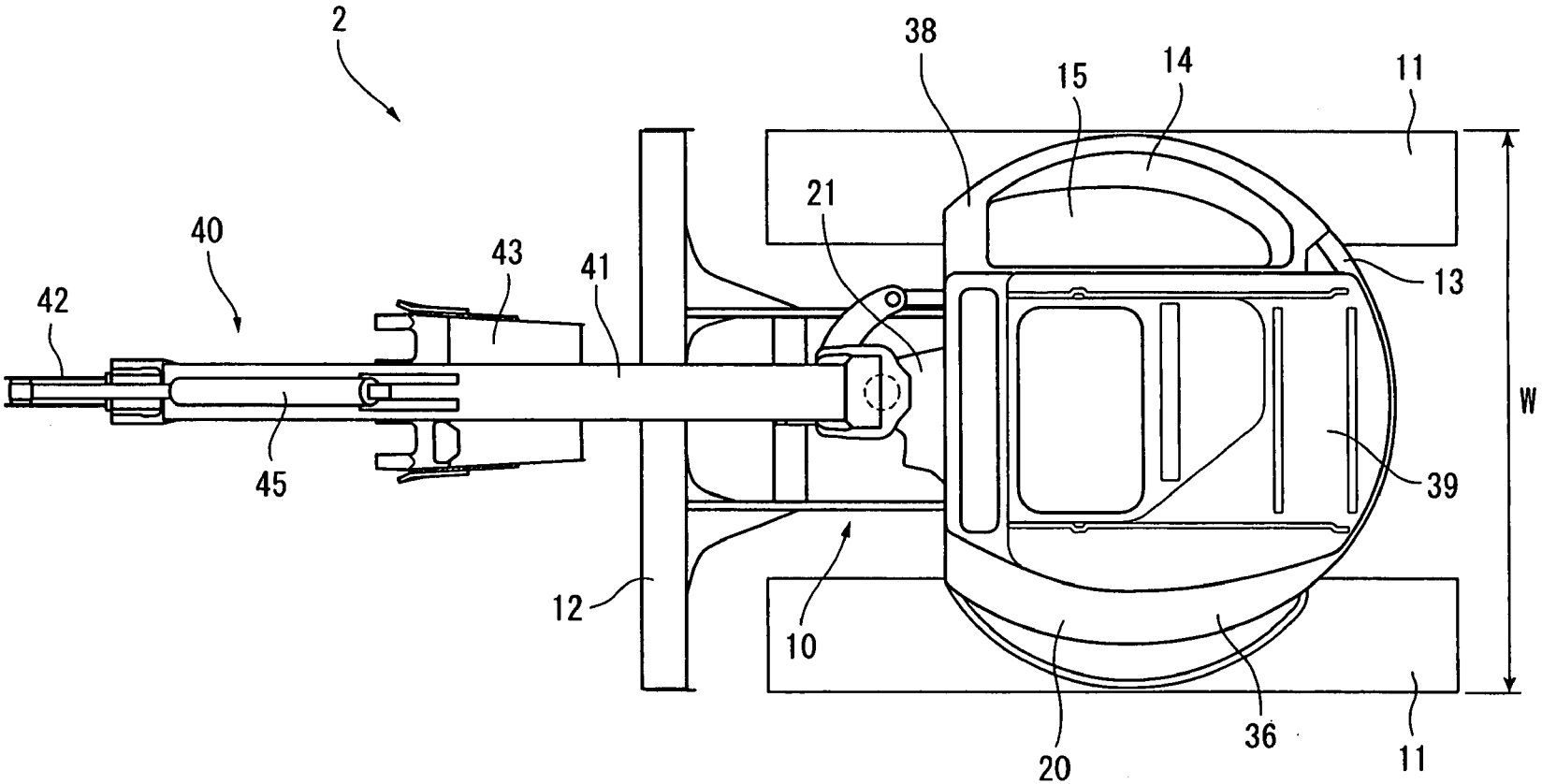
FIG. 9 is a schematic plan view of the second embodiment, showing the entire overhead view thereof.

FIG. 8 is a schematic lateral view of the hydraulic excavator 2, showing the entire profile of the cab model and FIG. 9 is a schematic plan view of the second embodiment, showing the entire overhead view thereof. Note that the work implement 40 is tilted differently in FIGS. 8 and 9.

The hydraulic excavator 2 of this embodiment differs from the hydraulic excavator 1 of the first embodiment in that the canopy 31 of the hydraulic excavator 1 is replaced with a box-shaped cab 39. Otherwise, the hydraulic excavator 2 has a configuration basically same as that of the hydraulic excavator 1. In other words, the manufacturing specifications of the work implement 40 are common to this hydraulic excavator 2 and the hydraulic excavator 1. The boom 41 can be tilted toward the seat (not shown) across the fitting section 21

The arrangement of providing a bubble removing device 60, that of separating the main tank 51 and the variable capacity tank 52 of the hydraulic tank 50 and that of fitting the variable capacity tank 52 to the rear surface of the upper cover 15 are also applied to the hydraulic excavator 2 of this embodiment as the downsizing scheme for the purpose of the present invention. Thus, with these arrangements, the seat-side block 14 is downsized to provide space on the upper swing body 20 so that the seat 30 (FIG. 1) and the cab 39 are placed rearward at a position close to the center on the upper swing body 20 compared with the positions of the seat and cab of a comparable conventional cab model.

Additionally, the cab 39 is made to have a larger capacity if compared with a comparable cab model of the prior art due to the space produced as a result of downsizing the seat-side block 14. In other words, a cab 39 that is used in a cab model hydraulic excavator of a larger type can be applied to this embodiment of the present invention. Note that, while the front surface of the cab 39 is advanced so as to be flush with the front surface of the upper swing body 20 in the cab model of this embodiment, it may be retracted so as to secure the through area 37. Even though the through area 37 is secured, the capacity of the cab 39 is not reduced significantly. In other words, the capacity of the cab 39 is sufficiently large compared with the capacity of the cab of a conventional service vehicle of the cab model.

The above described first and second embodiments provide the following advantages.

(1) The seat-side block 14 of the hydraulic excavator 1 and that of the hydraulic excavator 2 can be downsized by adopting the downsizing scheme including the arrangement of providing a bubble removing device 60 for removing bubbles from hydraulic fluid, that of using a hydraulic tank 50 having a main tank 51 and a variable capacity tank 52 that are separated from each other and that of fitting the variable capacity tank 52 to the rear surface of the upper cover 15. As a result, a large space can be provided around the seat 30. Thus, a canopy 31 or a cab 39 adapted to a large hydraulic excavator can be securely arranged on the upper swing body 20 of a small hydraulic excavator 1 or 2, whichever is appropriate. Since such large parts can be commonly used for both large hydraulic excavators and small hydraulic excavators, it is now possible to remarkably reduce the manufacturing cost of a service vehicle.

(2) Due to the provision of the downsizing scheme, the seat-side block 14 of the hydraulic excavator 1 or 2 is downsized to allow a step section 38 to be arranged in front of the seat-side block 14. Thus, a large space can be provided near the seat-side block 14 to allow the operator to move through it with ease. Therefore, particularly in the case of a hydraulic excavator of the canopy model, the operator can get easily onto the seat 30 from the outside and move away easily from the seat 30 to the outside by way of the step section 38 located near the seat-side block 14. Therefore, the advantages of the canopy model can be effectively exploited.

(3) Since the seat 30 is placed rearward at a position close to the center on the upper swing body 20 compared with the position of the seat of a comparable conventional service vehicle, a through area 37 can be provided behind the handrail 35 in the hydraulic excavator 1 of the canopy model. The through area 37 may be made to communicate with the step section 38. Then, the operator can move through the hydraulic excavator 1 by way of the through area 37 and the step section 38 without detouring around the vehicle even if the boom 41 or the like is tilted forward and held immobile. As a result, nothing blocks the operator from moving through the through area 37 and the step section 38.

(4) The cab 39 mounted on the hydraulic excavator 2 is enabled to be shifted rearward as a result of the provision of downsizing scheme so that the boom 41 of the work implement 40 can be tilted toward the seat 30 (the cab 39) across the fitting section 21 to a large extent. As a result, the front end of the boom 41 and that of the arm 42 of the work implement 40 can reach high positions like those of the hydraulic excavator 1 of the canopy model. Thus, the hydraulic excavator 2 can have a larger maximum dumping height and a larger maximum digging height. In other words, the hydraulic excavator 2 of the cab model can be made to have a working range that is as large as the working range of the hydraulic excavator 1 of the canopy model. Thus, the hydraulic excavator 2 of the cab model can be handled with ease.

(5) A work implement 40 can be commonly used for the hydraulic excavator 1 and the hydraulic excavator 2. In other words, the structure of the work implement 40 does not need to be modified depending on the model with which it is used. Therefore the work implement 40 can be handled and controlled easily during manufacturing of the hydraulic excavators 1 and 2 to further reduce the cost.

(6) The canopy 31 of the hydraulic excavator 1 and the cab 39 of the hydraulic excavator 2 are those that are compatible with larger hydraulic excavators. Thus, the canopy 31 is more effective for blocking sunlight and rain than that of a smaller hydraulic excavator, whereas the cab 39 provides a large internal space to allow the operator to operate more comfortably.

(7) Since a bubble removing device 60 is used as the downsizing scheme, it is no longer necessary to install a large capacity hydraulic tank of the prior art. Thus, particularly the main tank 51 of the hydraulic tank 50 can be made sufficiently small to reliably downsize the seat-side block 14.

(8) Since the hydraulic tank 50 is made to include a main tank 51 and a variable capacity tank 52 that are separated from each other for the purpose of downsizing, the maximum capacity of the variable capacity tank 52 for forming an air chamber 514 can be sufficiently reduced to thereby reduce the overall dimensions of the hydraulic tank 50. Thus, the seat-side block 14 can be reliably downsized.

(9) Since the variable capacity tank 52 is arranged at the rear surface of the upper cover 15 also for the purpose of downsizing, the space where the sound absorbing member 16 is bonded in the prior art can be effectively utilized in a service vehicle according to the present invention. Thus, it is not necessary to provide a space dedicated to the variable capacity tank 52 in the seat-side block 14 so that the seat-side block 14 can be further downsized.

Modified Embodiments

The present invention is by no means limited to the above described embodiments, which may be modified particularly in terms of configuration so as to achieve the object of the present invention as will be described below.

For example, the variable capacity tank 52 of each of the above described embodiments is realized by linking the fitting surface section 521 and the movable surface section 522 together by means of fiber-like confining members 523 so that the variable capacity tank 52 may inflate, while keeping its mattress-shape and the relative positions of the surface sections 521, 522. However, the structure of the variable capacity tank 52 is not limited thereto. Any of the structures illustrated in FIGS. 10 through 13 may alternatively be used.

Figure 10:
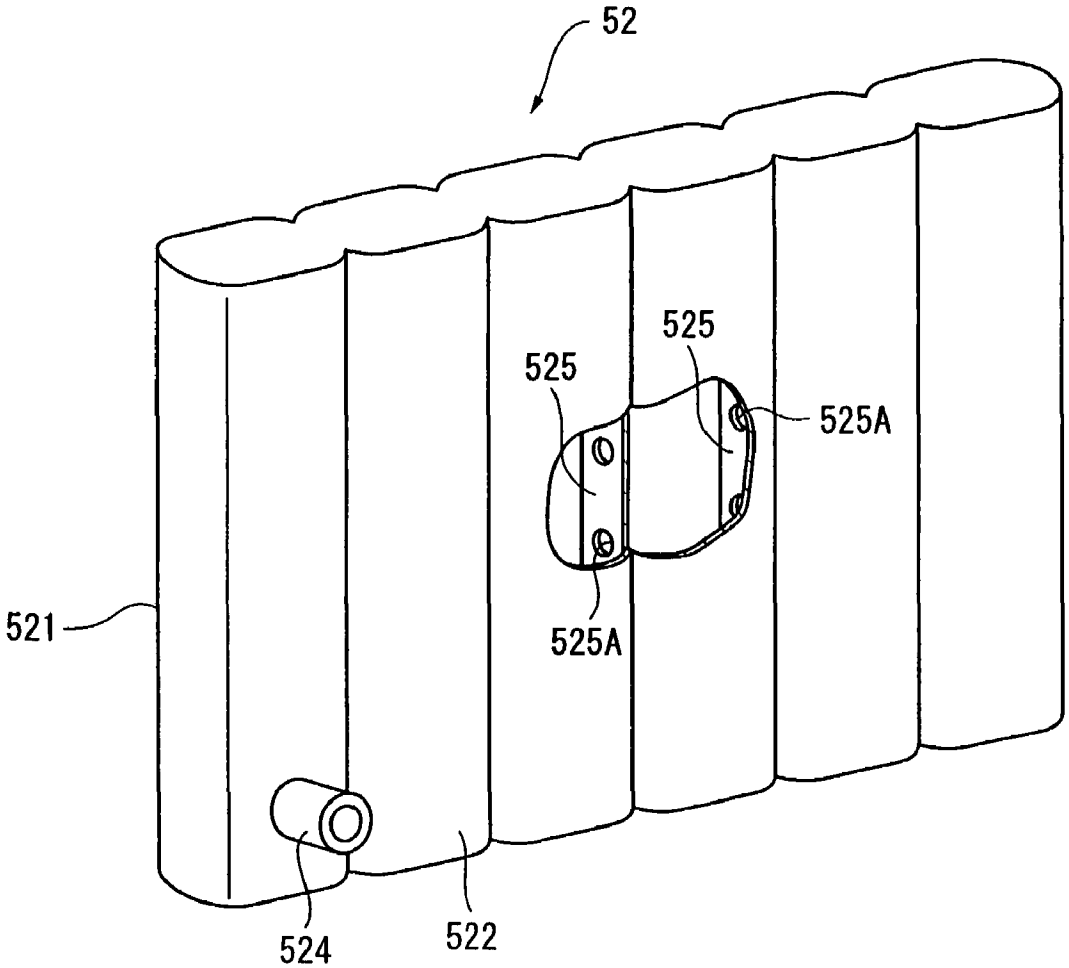
FIG. 10 is a schematic perspective view of the first modified embodiment of the present invention.

FIG. 10 (the first modified embodiment) shows a variable capacity tank 52 realized by linking the fitting surface section 521 and the movable surface section 522 together by means of a plurality of flat partition wall sections 525 arranged at regular intervals in a given direction. Each of the partition wall sections 525 is provided with holes 525A having an appropriate profile so that the internal spaces that are separated by the partition wall sections 525 communicate with each other.

Figure 11:
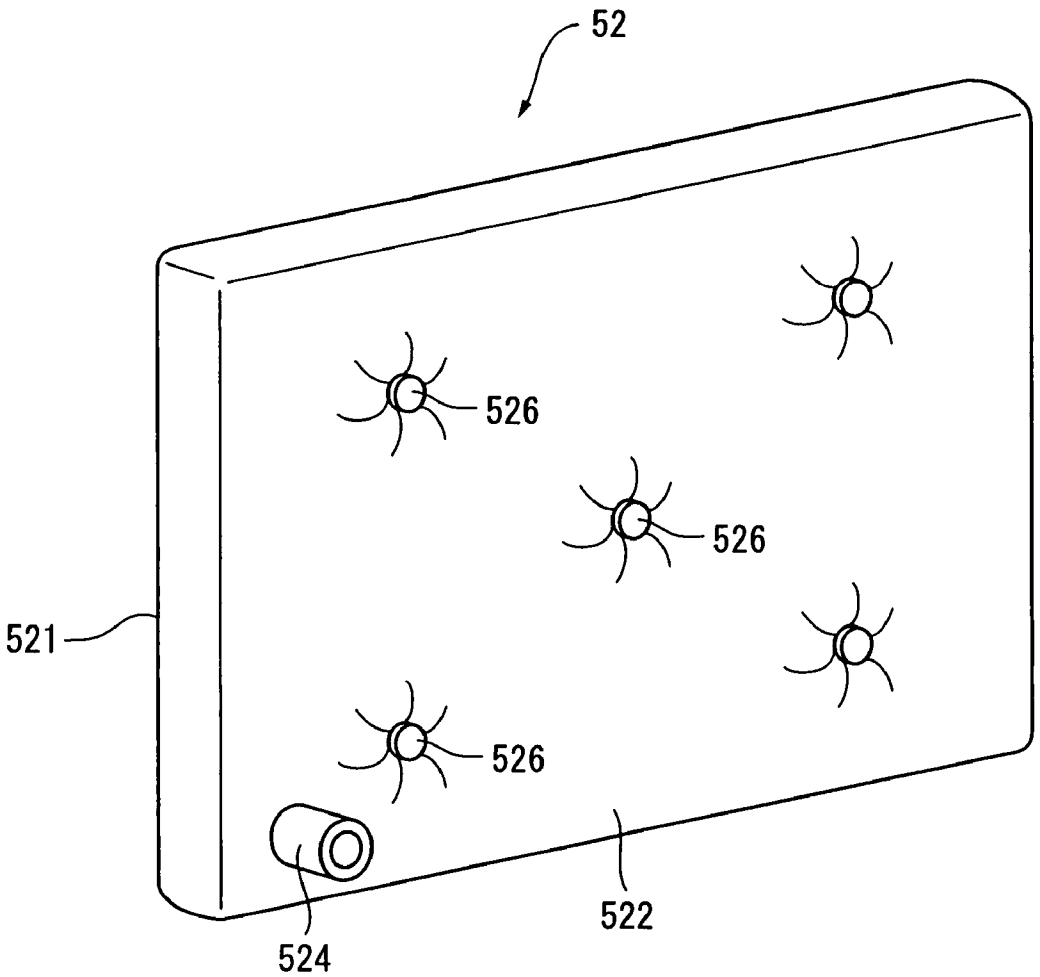
FIG. 11 is a schematic perspective view of the second modified embodiment of the present invention.

FIG. 11 (the second modified embodiment) shows a variable capacity tank 52 realized by arranging the fitting surface section 521 and the movable surface section 522 close to each other and linking them together by means of binding members 526 from the opposite external sides. Alternatively, the fitting surface section 521 and the movable surface section 522 may be linked together by spot bonding, typically using the technique of thermal fusion bonding without using binding members 526.

Figure 12:
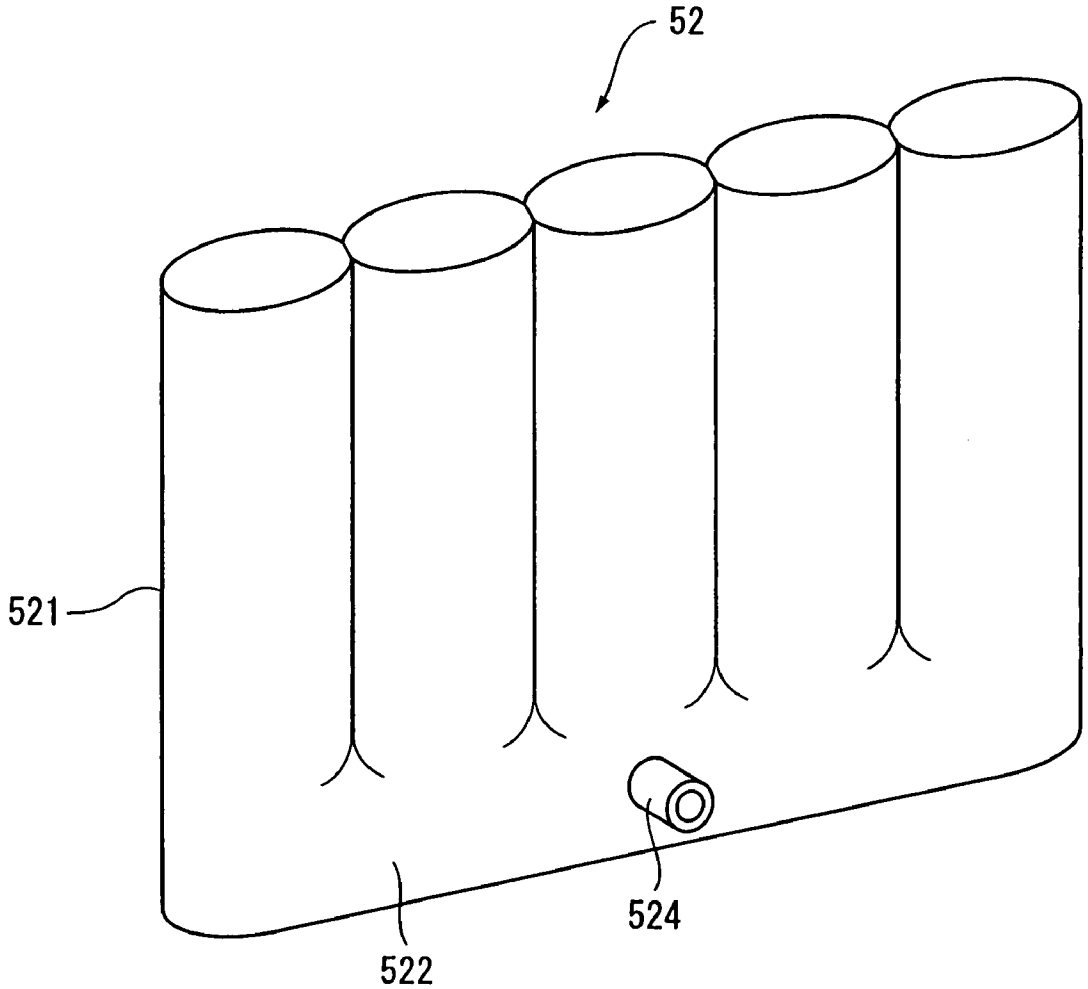
FIG. 12 is a schematic perspective view of the third modified embodiment of the present invention.

FIG. 12 (the third modified embodiment) shows a variable capacity tank 52 realized by directly bonding the fitting surface section 521 and the movable surface section 522 together in a given direction at regular intervals typically by using the technique of thermal fusion bonding. Note that the two surface sections 521, 522 are not bonded over the entire width thereof and have a lower unbonded zone that allows all the partitioned internal spaces to communicate with each other.

Figure 13:
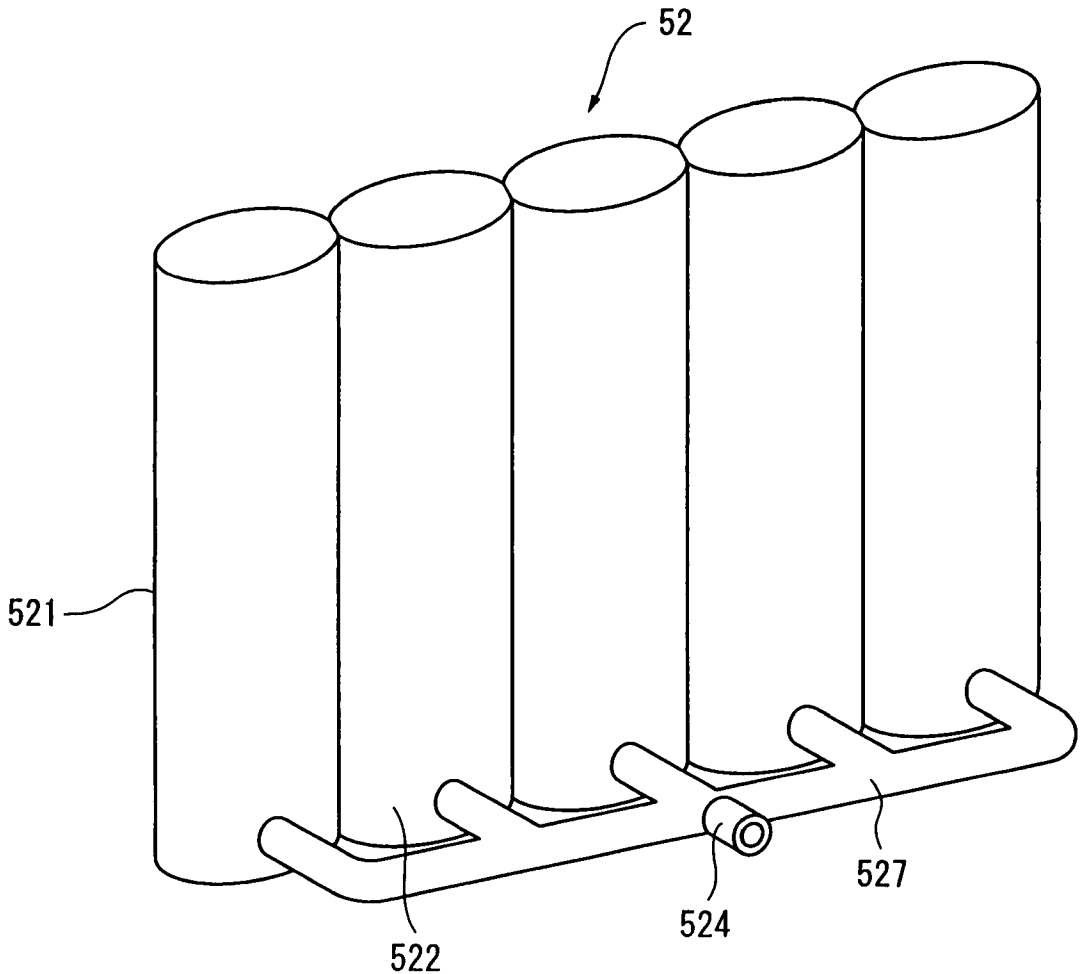
FIG. 13 is a schematic perspective view of the fourth modified embodiment of the present invention.

FIG. 13 (the fourth modified embodiment) shows a variable capacity tank 52 realized by directly bonding the fitting surface section 521 and the movable surface section 522 together in a given direction at regular intervals typically by using the technique of thermal fusion bonding over the entire width thereof. The variable capacity tank 52 is provided with a branching member 527 branched from a communicating section 524 in order to allow all the partitioned internal spaces to communicate with each other.

In short, the structure of the variable capacity tank 52 may be defined appropriately, taking the position where it is arranged, its external profile and its material into consideration. In other words, a structure other than those illustrated in FIGS. 10 through 13 may alternatively be used for the purpose of the present invention.

Figure 14:
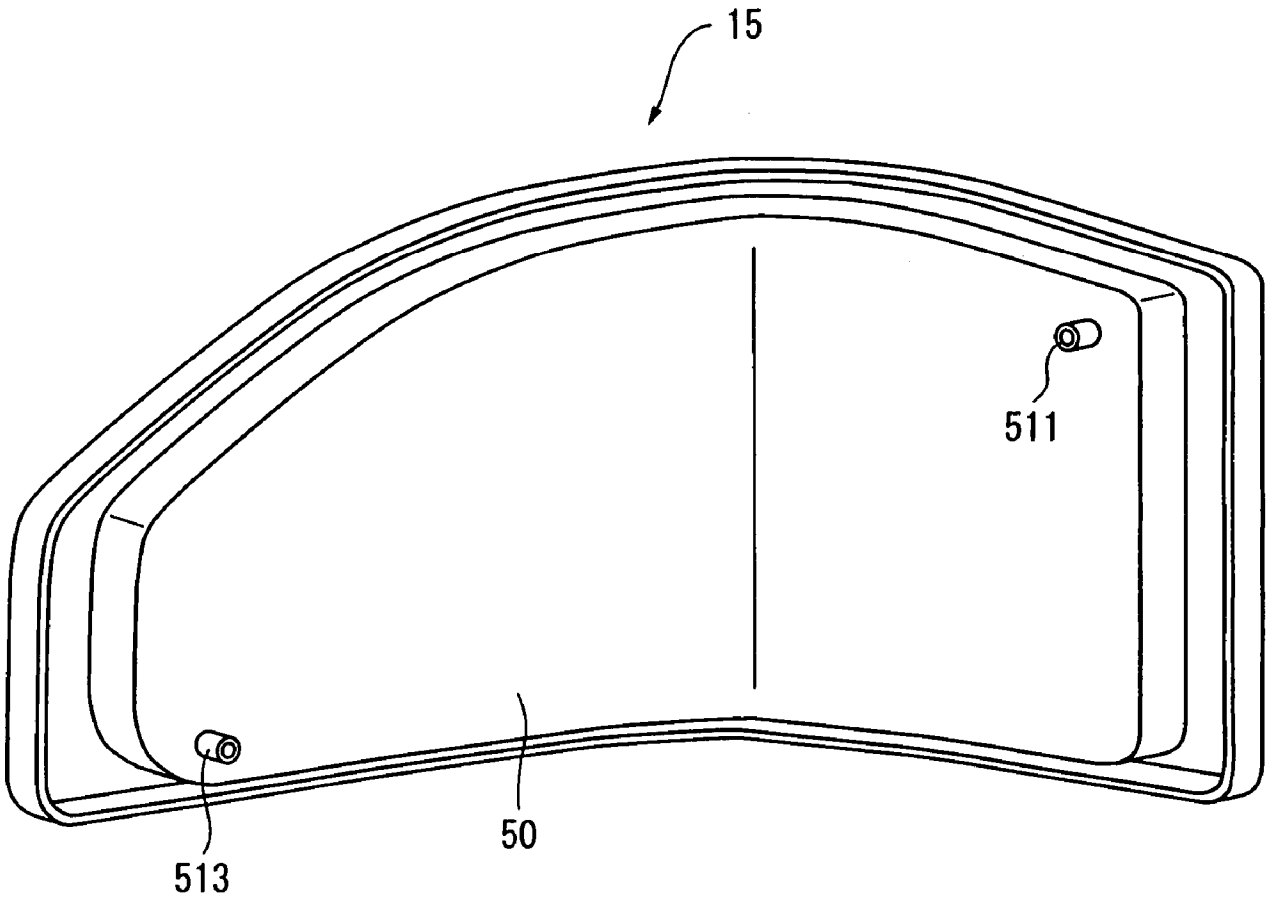
FIG. 14 is a schematic perspective view of the fifth modified embodiment of the present invention.

As for the hydraulic tank 50 of each of the above described embodiments, the main tank 51 is arranged in the seat-side block 14 like that of the prior art while the variable capacity tank 51 is arranged at the rear surface of the upper cover 15. However, the hydraulic tank 50 may be arranged at the rear surface of the upper cover 15 regardless of whether the tanks 51, 52 are put together or arranged separately. For example, FIG. 14 (the fifth modified embodiment) shows a hydraulic tank 50 fitted to the rear surface of the upper cover 15 and formed by integrally combining the tanks 51, 52.

The hydraulic tank 50 is made to have an external profile that fits the upper cover 15 or the sound absorbing member that is otherwise to be bonded there. All the spaces to be used for bonding the sound absorbing member are utilized for the purpose of fitting the hydraulic tank 50. With this arrangement, no problem arises in terms of the sound insulation effect because the hydraulic tank 50 provides a sound absorbing effect. The arrangement of fitting the hydraulic tank 50 to the upper cover 15 in place of a sound absorbing member constitutes another downsizing scheme for the purpose of the present invention because no dedicated space needs to be provided to contain the hydraulic tank 50 in the seat-side block 14 and hence the seat-side block 14 is downsized.

Further, an arrangement of making the whole hydraulic tank 50 flexible also constitutes a downsizing scheme for the purpose of the present invention. In this case, the hydraulic tank 50 can be provided at the space that corresponds to the heretofore dead space in the seat-side block 14. Thus, it is no longer necessary to provide a space dedicated to the hydraulic tank 50 in the seat-side block 14 so that the seat-side block 14 can be further downsized.

While the arrangement of separating the rigid main tank 51 and the flexible variable capacity tank 52 of the hydraulic tank 50 constitutes a downsizing scheme for the purpose of the present invention, both the main tank 51 and the variable capacity tank 52 may be made rigid or flexible so long as they are separated from each other because separation of the main tank 51 and the variable capacity tank 52 means that they are arranged in a distributed manner to fully exploit the dead space in the seat-side block 14.

Additionally, when the rigid part and the flexible part of the hydraulic tank 50 are put together, such an arrangement can also constitute a downsizing scheme for the purpose of the present invention because the hydraulic tank 50 can be downsized and hence the seat-side block 14 can also be downsized as illustrated in FIG. 7.

For the purpose of the present invention, the downsizing scheme can also be any positional arrangement or structure of the hydraulic tank 50 that is devised in a unique way to downsize the seat-side block 14. Furthermore, other downsizing schemes can additionally be provided in which the positional arrangement and the structure of any of the hydraulic control valve and the engine are designed so as to downsize the seat-side block 14.

A service vehicle according to the present invention is not limited to a hydraulic excavator as described above in terms of embodiments. A number and an arrangement of the hydraulic pump, hydraulic cylinder, engine and other components of a hydraulic excavator can be changed. The service vehicle may alternatively be a bulldozer or another construction machine or civil engineering machine.

What is claimed is:

1. A service vehicle comprising:

a vehicle main body;

an upper swing body mounted on the vehicle main body and adapted to turn within a width of the vehicle main body; and a downsizing device for reducing a size of a seat-side block adjacent to a seat on the upper swing body;

wherein the downsizing device comprises a hydraulic tank which is provided in the seat-side block, which includes a variable capacity tank; and wherein the variable capacity tank includes an attachment surface section to be attached to an inside of the seat-side block and a movable surface section which is movable with respect to and opposes the attachment surface section, and wherein an interior portion of the attachment surface section is coupled to an interior portion of the movable surface section.

2. The service vehicle according to claim 1, wherein the variable capacity tank is attached to a cover of the seat-side block.

3. The service vehicle according to claim 1, wherein the hydraulic tank further comprises a main tank coupled to the variable capacity tank.

4. The service vehicle according to claim 3, wherein only air flows between the variable capacity tank and the main tank.

5. The service vehicle according to claim 1, wherein the interior portion of the attachment surface section is coupled to the interior portion of the movable surface section by a plurality of fiber-like confining members extending from the interior portion of the attachment surface section to the interior portion of the movable surface section.

6. The service vehicle according to claim 1, wherein the interior portion of the attachment surface section is coupled to the interior portion of the movable surface section by a plurality of partition walls which partition a space between the attachment surface section and the movable surface section into a plurality of partitioned spaces.

7. The service vehicle according to claim 6, wherein each of the partition walls has a structure that allows communication between the partitioned spaces.

8. The service vehicle according to claim 7, wherein each of the partition walls has a plurality of holes.

9. The service vehicle according to claim 1, wherein the interior portion of the attachment surface section is coupled to the interior portion of the movable surface section by a plurality of binding members.

10. The service vehicle according to claim 9, wherein the plurality of binding members extend from an external side of the attachment surface section to an external side of the movable surface section through a space between the attachment surface section and the movable surface section.

11. The service vehicle according to claim 1, wherein the interior portion of the attachment surface section is coupled to the interior portion of the movable surface section by thermal fusion bonding.

12. The service vehicle according to claim 11, wherein the thermal fusion bonding is spot bonding.

13. The service vehicle according to claim 11, wherein the thermal fusion bonding partitions a space between the attachment surface section and the movable surface section into a plurality of partitioned spaces.

14. The service vehicle according to claim 13, wherein a zone is provided where the interior portion of the attachment surface section is not bonded to the interior portion of the movable surface section to allow communication between the partitioned spaces.

15. The service vehicle according to claim 13, wherein the variable capacity tank is provided with a branching member that intercommunicates the partitioned spaces.

* * * * *